US005403516A

United States Patent [19]

Bator et al.

[11] Patent Number: 5,403,516

[45] Date of Patent: Apr. 4, 1995

[54] SURFACTANT BLENDS FOR DETERGENT COMPOSITIONS

[75] Inventors: Patricia E. Bator, Secaucus; Barry A. Salka, Fair Lawn, both of N.J.

[73] Assignee: Henkel Corporation, Ambler, Pa.

[21] Appl. No.: 112,866

[22] Filed: Aug. 26, 1993

Related U.S. Application Data

[63] Continuation of Ser. No. 830,808, Feb. 4, 1992, abandoned.

[51] Int. Cl.[6] ..... C11D 1/14; C11D 1/68; C11D 1/70; C11D 1/83

[52] U.S. Cl. ..... 252/550; 252/135; 252/174.21; 252/174.19

[58] Field of Search ..... 252/550, 551, 546, 174.21, 252/174.22, 135, 174.14, DIG. 14, 174.19

[56] References Cited

U.S. PATENT DOCUMENTS

| | | | |
|---|---|---|---|
| 4,268,406 | 5/1981 | O'Brien et al. | 252/105 |
| 4,371,461 | 2/1983 | Jones et al. | 252/547 |
| 4,929,380 | 5/1990 | Schulz et al. | 252/121 |
| 4,933,101 | 6/1990 | Cilley et al. | 252/99 |
| 4,941,988 | 7/1990 | Wise | 252/99 |
| 5,047,165 | 9/1991 | Lysy et al. | 252/121 |

FOREIGN PATENT DOCUMENTS

| | | |
|---|---|---|
| 0253151 | 1/1988 | European Pat. Off. . |
| 2412837 | 10/1974 | Germany . |
| 3621536 | 1/1988 | Germany . |

*Primary Examiner*—Paul Lieberman
*Assistant Examiner*—E. M. Higgins
*Attorney, Agent, or Firm*—Ernest G. Szoke; Wayne C. Jaeschke; Real J. Grandmaison

[57] ABSTRACT

A surfactant blend for use in preparing clear liquid detergent compositions, the blend comprising a mixture of a short carbon chain anionic surfactant and a nonionic surfactant ethoxylated with from about 2 to about 7 moles of ethylene oxide. The anionic surfactant and nonionic surfactant are present in a weight ratio of from about 90:10 to about 50:50, respectively.

9 Claims, No Drawings

SURFACTANT BLENDS FOR DETERGENT COMPOSITIONS

This application is a continuation of application Ser. No. 07/830,808, filed on Feb. 4, 1992, now abandoned.

BACKGROUND OF THE INVENTION

1. Field of the Invention

This invention relates to special surfactant blends for use in detergent compositions, and more particularly, to surfactant blends comprising anionic and nonionic surfactants which provide excellent detergency and wetting characteristics.

The use of nonionic surfactants in detergent compositions serves primarily to improve their ability to clean oily and greasy soils. Generally, nonionic surfactants comprise an alkyl phenol or alcohol base which is alkoxylated with an alkylene oxide. Ordinarily, as the content of alkylene oxide is increased in the nonionic surfactant, its solubility is improved, however, its detersive power is decreased. By the same token, if one attempts to maintain the maximum detersive power of a nonionic surfactant by restricting its content of alkylene oxide, its solubility is poor and, thus, its detersive properties are lost.

The aforementioned problems are particularly manifested when one attempts to formulate a liquid detergent composition, particularly if one desires to obtain a clear composition, and more particularly so if the liquid detergent composition is to contain builder materials such as solid, granular silicates, phosphates and the like which makes solubility of the components even more difficult.

2. Discussion of Related Art

A liquid detergent based on nonionic surfactants and particulate builder materials is known from German Patent Application 36 21 536 which contains a liquid surfactant component of nonionic and anionic surfactants as well as polyethylene glycol having a molecular weight of approximately 200 to 600. Pursuant thereto, the addition of polyethylene glycol has the effect of improving the speed of dissolution of the detergent. However, polyethylene glycol makes practically no contribution to the washing result. Accordingly, there exists a need for a surfactant system that would retain its detersive power while possessing good solubility in a detergent composition.

DESCRIPTION OF THE INVENTION

In accordance with this invention, there is provided a special surfactant blend for use in detergent compositions wherein the surfactant blend comprises a mixture of short carbon chain anionic surfactant and nonionic surfactant having a low degree of ethoxylation. More specifically, the anionic surfactant preferably contains from 6 to 10 carbon atoms in its structure, and the nonionic surfactant contains from about 2 to about 7 moles of ethylene oxide in its composition. As indicated hereinbefore, nonionic surfactants containing only a low molar content of alkylene oxide such as ethylene oxide are powerful cleaners but suffer the drawback of having very poor water solubility. Thus, it has been found that a nonionic surfactant containing from about 2 to about 7 moles of ethylene oxide when mixed in certain proportions with an anionic surfactant containing from 6 to 10 carbon atoms in its chain overcomes the aforementioned solubility drawback and provides powerful detersive and wetting action to a detergent composition, for example, a laundry detergent composition containing builders.

Surfactant blends within the scope of the present invention having particularly balanced properties contain the aforementioned anionic surfactant and nonionic surfactant in a weight ratio of from about 90:10 to about 50:50. Preferably, when employed in a detergent composition, the content of these components may amount from about 5 to about 30 percent by weight, based on the weight of the entire detergent composition.

Detergents according to the invention have a distinctly better detergency performance on fatty and cosmetic soils compared with prior art detergents which do not contain the special surfactant blend described herein. In addition, when the detergents according to the invention contain builder materials, their cleaning properties are further enhanced. The foaming property of the detergents in washing machines is satisfactory.

In more detail, the anionic surfactant component of the special surfactant blend may be selected from the group consisting of short chain alcohol sulfates such as sodium 2-ethyl hexyl sulfate, sodium octyl sulfate and sodium decylsulfate. In addition, the alcohol sulfates may contain from about 2 to about 4 moles of ethylene oxide.

The nonionic surfactant component of the special surfactant blend may be selected from the group consisting of nonionic surfactants having a low degree of ethoxylation, i.e., containing from about 2 to about 7 moles of ethylene oxide. The nonionic surfactant may comprise an ethoxylated adduct of a fatty alcohol such as lauryl alcohol, myristyl alcohol, tridecyl alcohol, or an alkyl phenol such as an octyl phenol and a nonyl phenol.

The particulate builder materials optionally contained in the detergents according to the invention include organic and inorganic substances, preferably alkaline salts, in particular alkali metal salts, which are able not only to precipitate, or to sequester calcium ions, but also cause a synergistic increase of the wash efficiency with the surfactants and have a soil-dispersing or soil-suspending capacity. Of the inorganic salts, the water soluble alkali metaphosphates or alkali metal polyphosphates, in particular sodium tripolyphosphate are of particular importance. Organic complexing agents for calcium ions and heavy metal ions may be present as well as these phosphates. Among these are compounds such as amino polycarboxylic acids, e.g. nitrilotriacetic acid, ethylenediamine tetraacetic acid, diethylenetriamine pentaacetic acid as well as their higher homologues. Suitable organic complexing agents containing phosphorus include the water soluble salts of the alkane polyphosphonic acids, amino- and hydroxy-alkane polyphosphonic acids and phosphonopolycarboxylic acids, such as, for example, the compounds methane diphosphonic acids, dimethylamino methane-1,1-diphosphonic acids, amino trimethylene triphosphonic acids, ethylene diamine tetramethylene tetraphosphonic acids, diethylene triamine pentamethylene pentaphosphonic acids, 1-hydroxyethane-1,1-diphosphonic acids, and 2-phosphonobutane-1,2,4-tricarboxylic acids.

Of the organic builder materials, the N- and P-free polycarboxylic acids which form complex salts with calcium ions, to which polymerizates containing carboxyl groups also belong, are of particular importance. Low molecular weight compounds such as, e.g. citric acid, 2,2-oxydisuccinic acid and carboxy methyloxysuccinic acid are suitable. Suitable polymeric polycarboxylic acids have a molecular weight of from 350 to approximately 1,500,000 in the form of water soluble salts. Particularly preferred polymeric polycarboxylates have a molecular weight in the range of 500 to 175,000, and in particular in the range of 10,000 to 100,000. Among these are compounds such as, e.g. polyacrylic acid, poly-α-hydroxyacrylic acid, polymaleic acid as well as co-polymerizates of the corresponding monomeric carboxylic acids together or with ethylene unsaturated compounds, such as e.g. vinyl methylether. The water soluble salts of polyglyoxyl acids are also useful.

Suitable inorganic, non-complexing salts include the water-soluble bicarbonates, carbonates, borates, sulfates and silicates of the alkali metals, also described as "washing alkalis." Of the alkali metal silicates, the sodium silicates with a ratio $Na_2O:SiO_2$ of 1:1 to 1:3.5 are most useful.

Further builder materials which are used mainly in liquid compositions because of their hydrotropic properties include the salts of the non-capillary active sulfonic acids, carboxylic acids and sulfocarboxylic acids, containing 2 to 9 carbon atoms, for example the alkali metal salts of the alkane-, benzene-, toluene-, xylene- or cumene-sulfonic acids, sulfobenzoic acids, sulfophthalic acids, sulfoacetic acids, sulfosuccinic acids as well as the salts of acetic acid or lactic acid. Acetic amide and urea are also suitable as solubilizers.

Further constituents which may be contained, if desired, in the detergents according to the invention include anti-greying agents. Suitable anti-greying agents are cellulose ethers, such as carboxymethylcellulose, methylcellulose, hydroxyalkylcellulose, and mixed ethers such as methylhydroxyethylcellulose, methylhydroxypropylcellulose and methylcarboxymethylcellulose. Furthermore, mixtures of various cellulose ethers, in particular mixtures of carboxymethylcellulose and methylcellulose are suitable.

If it is desired that the detergent composition be in the form of a granular powder, then the composition may also contain the finely-divided synthetic sodium aluminosilicates of the zeolite-A type containing bound water, more fully described in German Patent 24 12 837 as phosphate substitutes for detergents and cleaning agents as water insoluble inorganic builder materials. Cation-exchanging sodium aluminosilicates are introduced in their usual hydrated, finely crystalline form, i.e., they have practically no particles larger than 30 microns and preferably at least 80% of which consist of particles of a size less than 10 microns. Their calcium-binding capacity, which may be determined according to German Patent 24 12 837, lies between 100 and 200 mg CaO/g. Zeolite NaA is particularly useful, as is Zeolite NaX and mixtures of zeolite NaA and NaX.

Such detergent composition may also additionally contain constituents having a bleaching effect. The perhydrates and per-compounds customarily used in detergents and bleaches come into consideration as bleaching agents. Sodium perborate is a preferred perhydrate, commonly used as a monohydrate or, in particular, as a tetrahydrate. In addition, perhydrates of sodium carbonate (sodium percarbonate), of sodium pyrophosphate (perpyrophosphate), of sodium silicate (persilicate) as well as of urea can be considered. These perhydrates are preferably used together with bleach activators. Preferably, sodium perborate tetrahydrate and sodium perborate monohydrate in combination with bleach activators come into consideration as bleaching components. N-acyl compounds and O-acyl compounds are particularly used as bleach activators. Examples of suitable N-acyl compounds are multiple acylated alkylene diamines, such as tetra-acetylmethylene diamine, tetra-acetyl ethylene diamine and their higher homologues, as well as acylated glycolurils, such as tetra-acetyl glycoluril. Further examples are Na-cyanimides, N-alkyl-N-sulphonylcarbonamides, N-acylhydantoins, N-acylated cyclic hydrazides, triazoles, urazoles, diketopiperazines, sulfurylamides, cyanurates and imidazolines. In addition to carboxylic acid anhydrides, such as phthalic acid anhydride and esters, such as Na-(iso)-nonanoylphenolsulfonate, acylated sugars, such as glucose penta-acetate can in particular be employed as O-acyl compounds. Preferred bleach activators are tetra-acetylethylene diamine and glucose penta-acetate. The bleach activators can also be covered with coating substances to avoid reaction with per-compounds or other substances, e.g. with enzymes. Detergent constituents of these types in the form of granulates, or granulates with coating substances lead to products with particularly valuable properties. As enzymes, those from the protease, lipase and amylase classes and mixtures thereof come into consideration. Particularly suitable are enzymatic active ingredients obtained from bacterial strains or fungi, such as bacillus subtilis, bacillus licheniformis and streptomyces griseus. In order to protect the enzymes against premature decomposition, normally they are embedded in coating substances.

The following examples further illustrate and describe the present invention, but are not intended to be limitations thereof since they are primarily to show the improved solubility properties of the surfactant blends of this invention.

EXAMPLE I

Blends of anionic surfactant and nonionic surfactant were prepared in the amounts shown in Table 1. The anionic surfactant comprised a 40% aqueous solution of sodium 2-ethylhexyl sulfate, and the nonionic surfactant comprised lauryl alcohol containing 2 or 3 moles of ethylene oxide per mole of lauryl alcohol.

TABLE 1

| Ingredient | % Wt/Wt | % Wt/Wt | % Wt/Wt | % Wt/Wt |
|---|---|---|---|---|
| Anionic surfactant | 90.0 | 75.0 | 90.0 | 75.0 |
| Nonionic surfactant - 2 E.O. | 10.0 | 25.0 | | |
| Nonionic surfactant - 3 E.O. | | | 10.0 | 25.0 |

After storage for one month at 45° C., all of the surfactant blends had remained clear, the criteria for stability of the blends.

EXAMPLE II

Blends of anionic surfactant and nonionic surfactant were prepared in the amounts shown in Table 2. The anionic surfactant comprised a 40% aqueous solution of sodium 2-ethylhexyl sulfate, and the nonionic surfactant comprised lauryl alcohol containing 4 or 7 moles of ethylene oxide per mole of lauryl alcohol.

TABLE 2

| Ingredient | % Wt/Wt | % Wt/Wt | % Wt/Wt | % Wt/Wt | % Wt/Wt | % Wt/Wt |
|---|---|---|---|---|---|---|
| Anionic surfactant | 90.0 | 75.0 | 50.0 | 90.0 | 75.0 | 50.0 |
| Nonionic | 10.0 | 25.0 | 50.0 | | | |

TABLE 2-continued

| Ingredient | % Wt/Wt | % Wt/Wt | % Wt/Wt | % Wt/Wt | % Wt/Wt | % Wt/Wt |
|---|---|---|---|---|---|---|
| surfactant - 4 E.O. | | | | | | |
| Nonionic surfactant -7 E.O. | | | | 10.0 | 25.0 | 50.0 |

After storage for one month at 45° C., all of the surfactant blends had remained clear.

EXAMPLE III

Blends of anionic surfactant and nonionic surfactant were prepared in the amounts shown in Table 3. The anionic surfactant comprised a 33% aqueous solution of sodium octyl sulfate, and the nonionic surfactant comprised lauryl alcohol containing 2, 3, 4 or 7 moles of ethylene oxide per mole of lauryl alcohol.

TABLE 3

| Ingredient | % Wt/Wt | % Wt/Wt | % Wt/Wt | % Wt/Wt |
|---|---|---|---|---|
| Anionic surfactant | 90.0 | 90.0 | 90.0 | 90.0 |
| Nonionic surfactant - 2 E.O. | 10.0 | | | |
| Nonionic surfactant - 3 E.O. | | 10.0 | | |
| Nonionic surfactant - 4 E.O. | | | 10.0 | |
| Nonionic surfactant - 7 E.O. | | | | 10.0 |

After storage for one month at 45° C., all of the surfactant blends had remained clear.

In addition, it was found that mixtures containing 50%/wt or more of the nonionic ethoxylates with this anionic surfactant were gels.

EXAMPLE IV

A blend of the anionic surfactants used in Examples II and III was prepared at a weight ratio of 75:25. That is, a blend of a 40% aqueous solution of sodium 2-ethylhexyl sulfate and of a 33% aqueous solution of sodium octyl sulfate was prepared at a weight ratio of 75:25, respectively. This mixture of anionic surfactants was blended with a nonionic surfactant comprising lauryl alcohol containing 2 or 3 moles of ethylene oxide per mole of lauryl alcohol in the amounts shown in Table 4.

TABLE 4

| Ingredient | % Wt/Wt | % Wt/Wt | % Wt/Wt | % Wt/Wt |
|---|---|---|---|---|
| Anionic blend | 90.0 | 75.0 | 90.0 | 75.0 |
| Nonionic surfactant - 2 E.O. | 10.0 | 25.0 | | |
| Nonionic surfactant - 3 E.O. | | | 10.0 | 25.0 |

After storage for one month at 45° C., all of the surfactant blends had remained clear.

EXAMPLE V

A blend of the anionic surfactants used in Examples II and III was prepared at a weight ratio of 75:25. That is, a blend of a 40% aqueous solution of sodium 2-ethylhexyl sulfate and of a 33% aqueous solution of sodium octyl sulfate was prepared at a weight ratio of 75:25, respectively. This mixture of anionic surfactants was blended with a nonionic surfactant comprising lauryl alcohol containing 4 or 7 moles of ethylene oxide per mole of lauryl alcohol in the amounts shown in Table 5.

TABLE 5

| Ingredient | % Wt/Wt | % Wt/Wt | % Wt/Wt | % Wt/Wt | % Wt/Wt | % Wt/Wt |
|---|---|---|---|---|---|---|
| Anionic surfactant | 90.0 | 75.0 | 50.0 | 90.0 | 75.0 | 50.0 |
| Nonionic surfactant - 4 E.O. | 10.0 | 25.0 | 50.0 | | | |
| Nonionic surfactant -7 E.O. | | | | 10.0 | 25.0 | 50.0 |

After storage for one month at 45° C., all of the surfactant blends had remained clear.

EXAMPLE VI

A blend of the anionic surfactants used in Examples II and III was prepared at a weight ratio of 50:50. That is, a blend of a 40% aqueous solution of sodium 2-ethylhexyl sulfate and of a 33% aqueous solution of sodium octyl sulfate was prepared at a weight ratio of 50:50, respectively. This mixture of anionic surfactants was blended with a nonionic surfactant comprising lauryl alcohol containing 2, 3, 4 or 7 moles of ethylene oxide per mole of lauryl alcohol in the amounts shown as in Tables 4 and 5.

After storage for one month at 45° C., it was found that all of the surfactant blends were clear solutions with the exception of the 50% wt./wt. anionic surfactant blend and 50% wt./wt. nonionic surfactant containing 2 moles of ethylene oxide which was a gel.

EXAMPLE VII

A blend of the anionic surfactants used in Examples II and III was prepared at a weight ratio of 25:75. That is, a blend of a 40% aqueous solution of sodium 2-ethylhexyl sulfate and of a 33% aqueous solution of sodium octyl sulfate was prepared at a weight ratio of 25:75, respectively. This mixture of anionic surfactants was blended with a nonionic surfactant comprising lauryl alcohol containing 2, 3, 4 or 7 moles of ethylene oxide per mole of lauryl alcohol in the amounts shown as in Tables 4 and 5.

After storage for one month at 45° C. it was found that the only clear preparations were those containing 90% wt./wt. of the anionic surfactant blend and 10% wt./wt. of the nonionic surfactants.

EXAMPLE VIII

A liquid detergent composition was prepared from a surfactant mixture containing 50 wt. % of a nonionic surfactant comprising lauryl alcohol containing 2 moles of ethylene oxide per mole of lauryl alcohol, and 50 wt. % of an anionic surfactant comprising a 30% aqueous solution of sodium 2-ethyl hexyl sulfate. This final surfactant mixture contained 50 wt. % nonionic, 15 wt. % anionic, and 35 wt. % water. The final surfactant mixture was employed to prepare the following formulation.

Detergent Formulation

| Ingredients | % Wt/Wt |
|---|---|
| Nonionic/anionic mixture | 37.5 |
| Sodium xylene sulfonate (40%) | 6.0 |
| Sodium citrate dihydrate | 6.0 |
| Sodium metasilicate pentahydrate | 6.0 |
| Deionized water | 44.5 |

-continued

| Detergent Formulation | |
|---|---|
| Ingredients | % Wt/Wt |
| | 100.0 |

A clear, stable liquid product was obtained.

What is claimed is:

1. A composition consisting of a mixture of an anionic surfactant containing from 6 to 10 carbon atoms selected from the group consisting of alcohol sulfates and a nonionic surfactant ethoxylated with from about 2 to about 7 moles of ethylene oxide selected from the group consisting of a fatty alcohol and an alkyl phenol, said anionic surfactant and said nonionic surfactant being present in a weight ratio of from about 90:10 to about 50:50, respectively.

2. A composition as in claim 1 wherein said anionic surfactant is selected from the group consisting of sodium 2-ethyl hexyl sulfate, sodium octyl sulfate, and sodium decyl sulfate.

3. A composition as in claim 1 wherein said fatty alcohol is selected from the group consisting of lauryl alcohol, myristyl alcohol, and tridecyl alcohol.

4. A clear, liquid detergent consisting of from about 5 to about 30 percent by weight, based on the weight of said detergent, of a composition consisting of a mixture of an anionic surfactant containing from 6 to 10 carbon atoms selected from the group consisting of alcohol sulfates and a nonionic surfactant ethoxylated with from about 2 to about 7 moles of ethylene oxide selected from the group consisting of a fatty alcohol and an alkyl phenol, said anionic surfactant and said nonionic surfactant being present in a weight ratio of from about 90:10 to about 50:50, respectively and the balance builder components and water.

5. A detergent as in claim 4 wherein said anionic surfactant is selected from the group consisting of sodium 2-ethyl hexyl sulfate, sodium octyl sulfate, and sodium decyl sulfate

6. A detergent as in claim 4 wherein said fatty alcohol is selected from the group consisting of lauryl alcohol, myristyl alcohol, and tridecyl alcohol.

7. The process of preparing a clear liquid detergent consisting of a nonionic surfactant ethoxylated with from about 2 to about 7 moles of ethylene oxide selected from the group consisting of a fatty alcohol and an alkyl phenol, consisting of adding to said detergent an anionic surfactant selected from the group consisting of alcohol sulfates containing from 6 to 1.0 carbon atoms wherein said anionic surfactant and said nonionic surfactant are present in a weight ratio from about 90:10 to about 50:50, respectively, and in an amount of from about 5 to about 30 percent by weight, based on the weight of said detergent and the balance builder components and water.

8. The process as in claim 7 wherein said anionic surfactant is selected from the group consisting of sodium 2-ethyl hexyl sulfate, sodium octyl sulfate, and sodium decyl sulfate.

9. The process as in claim 7 wherein said fatty alcohol is selected from the group consisting of lauryl alcohol, myristyl alcohol, and tridecyl alcohol.

* * * * *

UNITED STATES PATENT AND TRADEMARK OFFICE

CERTIFICATE OF CORRECTION

PATENT NO. : 5,403,516

DATED : Apr. 4, 1995

INVENTOR(S) : Patricia E. Bator, Barry A. Salka

It is certified that error appears in the above-indentified patent and that said Letters Patent is hereby corrected as shown below:

In col. 8, line 18, delete [1.0] and insert --10--.

Signed and Sealed this

Tenth Day of September, 1996

*Attest:*

BRUCE LEHMAN

*Attesting Officer*

*Commissioner of Patents and Trademarks*